US006051352A

United States Patent [19]

Umeno et al.

[11] Patent Number: 6,051,352

[45] Date of Patent: Apr. 18, 2000

[54] CARRIER FOR DEVELOPING ELECTROSTATIC IMAGE, DEVELOPER AND DEVELOPING METHOD

[75] Inventors: Tomoyasu Umeno; Ryuji Kitani; Tatsuya Nagase; Meizo Shirose, all of Hachioji, Japan

[73] Assignee: Konica Corporation, Tokyo, Japan

[21] Appl. No.: 09/146,814

[22] Filed: Sep. 4, 1998

[30] Foreign Application Priority Data

Sep. 9, 1997 [JP] Japan ..... 9-243933

[51] Int. Cl.[7] ..... G03G 9/10

[52] U.S. Cl. ..... 430/106.6; 430/108

[58] Field of Search ..... 430/108, 106.6, 430/137

[56] References Cited

U.S. PATENT DOCUMENTS

| | | | |
|---|---|---|---|
| 4,264,697 | 4/1981 | Perez et al. | 430/107 |
| 4,298,672 | 11/1981 | Lu | 430/108 |
| 5,441,839 | 8/1995 | Ishikawa et al. | 430/108 |
| 5,766,814 | 6/1998 | Bada et al. | 430/108 |

FOREIGN PATENT DOCUMENTS

| | | |
|---|---|---|
| 49-051951 | 5/1974 | Japan . |
| 52-010141 | 1/1977 | Japan . |
| 54-158932 | 12/1979 | Japan . |
| 56-11461 | 2/1981 | Japan . |
| 2-008860 | 1/1990 | Japan . |

*Primary Examiner*—John Goodrow
*Attorney, Agent, or Firm*—Cantor Colburn LLP

[57] ABSTRACT

A carrier for developing an electrostatic latent image is disclosed. The carrier comprises a magnetite core and a resin coated on the magnetite core wherein the magnetite core contains FeO and $Fe_2O_3$, the mole ratio of $FeO/Fe_2O_3$ being 0.15/1.0 to 0.7/1.0, and the carrier contains a magnesium atom containing material at a surface of the carrier, magnesium atom content ratio at the surface being 1.5 to 5.0 (percent in the number of atoms).

A developer for developing an electrostatic latent image using the carrier and a developing method using the carrier or the developer is also disclosed.

18 Claims, No Drawings

CARRIER FOR DEVELOPING ELECTROSTATIC IMAGE, DEVELOPER AND DEVELOPING METHOD

FIELD OF THE INVENTION

The present invention relates to a carrier for developing an electrostatic latent image (hereinafter referred to as carrier), a developer material for developing the same (hereinafter referred to as developer material), and a development method, which are employed in copiers, laser printers, and the like utilizing an electrophotographic system.

BACKGROUND OF THE INVENTION

As a two component developer material employed in the development method in copiers, laser printers, and the like, utilizing the electrophotographic system, a negatively charged toner is generally mixed with a positively charged carrier. The carrier is employed to apply, to the toner, an appropriate amount of triboelectrical charge with negative polarity.

In recent years, image forming apparatuses such as laser printers, to which the electrophotographic system is applied, have shown a tendency toward a decrease in the size. Along with this tendency, the image forming apparatus itself and particularly, the development device comprising a development unit have been subjected to the decrease in the size. Accordingly, in a small-sized development device, the amount of the developer material employed to develop electrostatic latent images inevitably becomes small.

In the above-mentioned negatively chargeable two component development material, during a short period of time while a supplied toner is transported to a development zone to develop an electrostatic latent image, an appropriate amount of negative polarity triboelectrical charge is required to apply to the above-mentioned toner, that is, improvement in charge rising properties is required.

In view of the foregoing, as a means to improve the charge rising properties, a technique is disclosed (for example, in Japanese Patent Publication Open to Public Inspection No. 2-8860) in that a positively chargeable charge control agent is incorporated into the resin coated layer of a resin coated carrier.

Positively chargeable charge control agents known in the art include quaternary ammonium compounds disclosed in Japanese Patent Publication Open to Public Inspection Nos. 49-51951, 52-10141, and alkylpyridinium compounds and alkylpicoridium compounds (for example, nigrosine SO, nigrosine EX, etc.), disclosed in Japanese Patent Publication Open to Public Inspection Nos. 56-11461 and 54-158932.

The conventional positively chargeable charge control agents known are organic compounds having a large cohesive force and are inferior in being dispersed to and mixed with a coating resin. Due to that, it has been impossible to uniformly disperse the positively chargeable charge control agent into the resin coating layer of the carrier and to apply, to the toner, an appropriate amount of the triboroelectric charge with negative polarity. As a result, there are problems with toner scattering and background stain.

On the other hand, in a magnetic carrier core constituting the carrier employed in the two component developer materials, the ferrite series carrier core comprising heavy metals such as copper (Cu), etc. has been widely employed. However, from the view of the adaptability to the recent environmental regulations, carrier cores require no such heavy metals. In this case, a so-called magnetite composition core (magnetite core) exhibits remarkably high adaptability in which the carrier core is only composed of iron (Fe), and oxygen (O), and has a crystal structure in that ferrous oxide (FeO), and ferric oxide ($Fe_2O_3$), are mixed as constituting components.

The magnetite composition core shows a tendency to have comparatively large magnitudes of magnetism and is not preferred for a development method in which an electrostatic latent image is developed in a non-contact state. Accordingly, it has been difficult to apply the magnetite core to a non-contact development method unless the magnitude of magnetism is adjusted to the decreasing direction without varying the magnetite composition.

During an initial stage, and even normal running stage, carrier adhesion results in abrasion on an electrostatic latent image bearing body and causes a problem of white streak image defect.

SUMMARY OF THE INVENTION

A first object of the present invention is to provide a carrier for developing an electrostatic latent image, which causes no white streak image defect in such a manner that during a normal running stage as well as an initial stage, because no carrier adhesion results, no abrasion is caused on an electrostatic latent image bearing body.

A second object is to provide a developer material for developing an electrostatic latent image, which causes neither toner scattering nor background stain on images during an extended period of electrostatic latent image development.

A third object is to provide a development method which can form an excellent image exhibiting neither carrier adhesion nor image defects, such as white streak image, and neither toner scattering nor background stain on images.

The carrier for developing an electrostatic latent image of the present invention comprises a magnetite core and a resin coated on the magnetite core, and the magnetite core contains FeO and $Fe_2O_3$ as main components; the mole ratio of $FeO/Fe_2O_3$ is 0.15/1.0 to 0.7/1.0, and at the same time, the magnesium atom content ratio is 1.5 to 5.0 (percent in the number of atoms).

The magnesium atom containing material is preferably that exhibits a weight decrease ratio of 2 to 30 weight percent in the range of 200 to 500° C., when heated at a rate of 5° C./minute in the atmosphere.

In a carrier for developing an electrostatic latent image, comprised of a magnetite core and a resin coated on the magnetite core, the carrier for developing an electrostatic latent image, which is characterized in that the magnetite core contains FeO and $Fe_2O_3$ as main components and the mole ratio of $FeO/Fe_2O_3$ is 0.15/1.0 to 0.7/1.0, and a magnesium atom containing material is incorporated which exhibits a weight decrease ratio of 2 to 30 weight percent in the range of 200 to 500° C., when heated at a rate of 5° C./minute in the atmosphere.

A developer material for developing an electrostatic latent image comprises the carrier described above and a toner containing at leas t a binder resin and a colorant.

In a development method for developing an electrostatic latent image on an latent image bearing body in such a manner that on a developer material bearing body, the developer material is borne and the developer material layer is formed so as not to be in contact with an electrostatic latent image bearing body, a development method which is characterized in employing the developer material.

DETAILED DESCRIPTION OF THE INVENTION

Carrier

The carrier is characterized in the composition of magnetite particles employed as a core material and specifically, $FeO/Fe_2O_3$ mole ratio is in the range of 0.15/1.0 to 0.7/1.0.

The magnetite core has a crystal structure in which ferrous oxide (FeO) and ferric oxide ($Fe_2O_3$) are mixed as constituting components. Of these, FeO composition part exhibits greater electrical conductivity than the part of $Fe_2O_3$ composition. The presence of the appropriate amount of FeO component in the crystal structure enables the easy charge exchange of an iron ion between divalence and trivalence to exhibit very large electrical conductivity. Namely, the electrical conductivity largely depends on the content of FeO.

Furthermore, the magnetite core has a crystal structure in which FeO and $Fe_2O_3$ are mixed as constituting components. It is considered that an appropriate mount of the FeO component constitutes a spinel series structure (spinel type structure and/or a reverse spinel structure) and such a spinel series component exhibits the great magnetism.

By controlling a mole ratio of $FeO/Fe_2O_3$ to in the range of 0.15/1.0 to 0.7/1.0, a non-contact development method can be applied and the magnetite core having excellent electrical conductivity was prepared. By employing this magnetite, neither carrier scattering nor white streak image are caused and in addition, the carrier exhibiting stable charging at high humidity was obtained.

The content of each of FeO and $Fe_2O_3$ in the magnetite core can be calculated as follows.

The content of Fe in a FeO component, that is, divalent iron can be obtained in such a manner that the magnetite core is dissolved in a suitable aqueous solution under the conditions in which each iron ion is not subjected to neither oxidation nor reduction and the divalent iron ion ($Fe^{2+}$) is subjected to quantitative analysis employing a titration method.

Furthermore, the content of $Fe_2O_3$ can be obtained in such a manner that in the same way, the above-mentioned magnetite is dissolved in a suitable aqueous solution under the conditions so that all the ferrous ions are oxidized to ferric ions; the total content of ferric ions ($Fe^{3+}$) contained in the resulting solution is analyzed, and the content of the ferrous ions is subtracted from the resulting content.

Being based on these results, the content ratio of FeO to $Fe_2O_3$ was calculated.

In the carrier, the magnesium content ratio in the surface portion of the carrier for developing an electrostatic latent image is between 1.5 and 5.0 (percent in the number of atoms). In this Specification, "the surface portion of the carrier for developing an electrostatic latent image" refers to not more than 20 nm depth from the surface of the carrier for developing an electrostatic latent image, which is coated with a resin.

The magnesium atom is an atom exhibiting great electron donating properties and the atom itself is subjected to very large positive chargeability (i.e. great negative charge donating properties). By controlling the above-mentioned magnesium content ratio (hereinafter occasionally referred to as "Mg amount") at 1.5 to 5.0 (percent in the number of atoms), charge rising properties and charge holding properties are optimized at the same time, and it is possible to remarkably improve the negative charge donating properties to a toner. When the value of the Mg amount is between 1.5 and 5.0 (percent in the number of atoms), preferred charge rising properties and excellent charge holding properties are obtained, and it is possible to apply the sufficient negative chargeability to the toner and it is possible to minimize toner scattering and background stain on images. Furthermore, during mixing over an extended period of time or under the environment with high humidity, the stable negative charge donating properties are obtained and toner scattering and background stains on images are minimized.

The content ratio of the magnesium atom in the carrier surface portion can be measured employing an X-ray photoelectron spectroscopic analyzer (XPS). Specifically, by employing an X-ray photoelectron spectroscopic analyzer "ESCA-1000" (manufactured by Shimadzu Seisakusho Co.), the quantitative analysis of each element is conducted under analytical conditions mentioned below and the content ratio of the magnesium atom is calculated employing the peak area of each atom.

Content ratio of magnesium atom (Mg amount)=(Peak area of Mg atom)/(Sum of peak areas of 5 atoms of C, O, Fe, Si, Mg)

(Analytical Conditions)

X-ray: Mg anode type (1253, 6 eV)

Acceleration: 10 kV, 30 mA

Resolving power: 31.5 eV

Measurement element: carbon, oxygen, iron silicone, magnesium

The carrier is preferably comprised of, in the coating resin layer, a magnesium atom containing material, which exhibits a weight decrease ratio of 1 to 30 weight percent in the temperature range of 200 to 500° C., when heated at a rate of 5° C./minute.

The magnesium atom containing material exhibits properties such that upon reacting with moisture in the atmosphere, hydration occurs via hydration bonding on the surface. As the above mentioned magnesium containing material is subjected to hydration through reacting with moisture in the atmosphere, the triboelectrical charge donating properties result in variation. Furthermore, the performance remarkably varies at the early stage of hydration.

When the weight decrease rate (sometimes termed "W (loss)") in a temperature range of 200 to 500° C. when heated at a rate of 5° C./minutes in the atmosphere, which represents a scale of hydration water amount, a triboelectrical charge application can be stably carried out in spite of environmental variation.

The weight decrease rate "W (loss)" is herein measured employing a thermal balance analyzer "TG-50" type manufactured by Shimadzu Seisakusho Co. upon heating at a rate of 5 ° C./minute in the atmosphere.

In consideration of charge applying stability to a toner, supply capability of a toner to an electrostatic latent image part, transfer of a carrier to an electrostatic latent image (carrier adhesion), etc., the carrier having a volume average particle diameter of 15 to 80 $\mu$m can be preferably employed. The volume average particle diameter is measured employing a laser diffraction type particle distribution measurement apparatus "HELOS" (manufactured by Nihon Denshi Co.). At the time, carrier particles were put into a 50 cc beaker together with a measurement sample, a surface active agent, and water as a dispersion medium and the resulting mixture was then dispersed for 120 seconds employing a ultrasonic homogenizer and was measured.

Carrier Constituting Materials

Magnesium atom containing materials employed in a carrier are preferably those such as, particularly, oxides (for example, magnesium oxide, etc.), hydroxides (for example, magnesium hydroxide, etc.), carbonates (for example, magnesium carbonate, etc.), or mixtures of oxides and carbonates.

Magnesium oxide can be prepared by oxidizing (combustion) magnesium metal, or thermally decomposing magnesium carbonate, magnesium hydoxycarbonate, magnesium hydroxide. In addition, magnesium oxide can be prepared by growing single crystals upon oxidizing magnesium vapor under the presence of oxygen.

Magnesium hydroxide can be prepared by adding an alkali to an aqueous magnesium compound solution prepared by dissolving a magnesium compound such as magnesium oxide, magnesium carbonate, magnesium hydroxycarbonate, etc. in water; adding alkali to the aqueous magnesium solution, and applying heat and pressure to the resulting solution. Furthermore, magnesium hydroxide can be prepared by growing single crystals upon oxidizing magnesium under the presence of steam containing no carbon dioxide.

Magnesium carbonates include magnesium hydroxycarbonate represented by "(3 to 5)$MgCO_3$.$Mg(OH)_2$.(3 to 7)$H_2O$" other than that represented by "$MgCO_3$".

As the production method of those magnesium carbonates, for example, trihydrate polycrystals are prepared by adding sodium carbonate to an aqueous magnesium compound solution while introducing carbon dioxide, and non-hydrate polycrystals are prepared by drying and dehydrating the resulting trihydrate under carbon dioxide gas. Furthermore, they can be prepared by growing single crystals upon oxidizing magnesium vapor under carbon dioxide gas.

The BET specific surface area of a magnesium atom containing material is preferably between 5 and 300 $m^2/g$, and more preferably between 10 and 200 $m^2/g$. Furthermore, the average particle diameter is preferably between 10 nm and 3 $\mu$m, and more preferably between 50 nm and 2.5 $\mu$m. In this case, it is estimated that the magnesium atom containing material can be more homogeneously dispersed into a coating layer composed of a resin, and as a result, the negative charge applying properties to a toner can be remarkably improved.

The BET specific surface area of the magnesium atom containing material is measured by a Micromeritics Flowsorp II2300 type manufactured by Micro Meritics Co. The number average particle diameter herein is referred to the number average particle diameter of the primary particles (particles which are separated into each unit particle), and for example, the number average particle diameter is measured in such a manner that a photographic image photographed by a transmission type electron microscope (TEM) "JEM-2000FX" (manufactured by Nihon Denshi Co.) is processed employing an image analyzing apparatus "SPICCA" (manufactured by Nihon Abionics Co.) to measure the diameter (the same measurement is employed below).

As coating resins comprised of a carrier, those may be employed which can apply, to a toner, triboelectrical charge with negative polarity through friction with the toner. For example, styrene series resins, acryl series resins, styrene-acryl series copolymer resins, and blended resins thereof are preferred from the view point of charge applying properties and coating layer forming capability (film forming properties), etc.

The glass transition point (Tg) of the coating resin is preferably between 50 and 200° C. and its softening point (Tsp) is preferably between 80 and 300° C., because resins having those points exhibit excellent binding properties onto the surface of a core particle and improved durability. The glass transition point (Tg) and softening point (Tsp) of the coating resin can be controlled by choosing compositions and molecular weight of the resin. The glass transition point (Tg) herein is measured employing DSC "506S" (manufactured by Seiko Denshi Co.) (the same measurement is employed below). The softening point (Tsp) herein is measured employing an elevated type flow tester "Flow Tester" (manufactured by Shimadzu Seisakusho Co.) (the same measurement is employed below).

In case that the resin is coated by so-called dry method, the shape of the coating resin is preferably of fine spherical particles, and the number average diameter is preferably between 10 and 5,000 nm. The particle resin is coated on the core by applying mechanical force. Such a fine particle resin is prepared employing suspension polymerization, emulsion polymerization, soap-free emulsion polymerization, etc. The number average primary particle diameter herein is measured employing a particle distribution measurement apparatus "LPA-3000/3100" (manufactured by Ohtsuksa Denshi Co.) (the same measurement is employed below).

Carrier Preparation Method

The carrier can be prepared employing various methods.

For example, a resin coated carrier employing a magnetite core can be prepared by a method generally termed a wet method in which a coating resin is dissolved in a suitable organic solvent; a coating solution is then prepared by mix dispersing a magnesium containing material to the resulting solution; with the use of the coating composition, a coating layer is formed on the surface of the particles of the magnetic substance employing a method such as a dipping method, a dry-spray method, a fluidized bed method, etc. and the resulting is then heated or rested. Or the preparation can be performed using a method generally termed a dry method which employs no solvent, when forming a coating layer.

The coating resin is employed in an amount of 0.05 to 8.0 weight percent of a core material.

In order to control the resistance of a carrier and accomplish various other purposes, an interlayer may be provided which is composed of resins and other materials.

<Developer Material)

The developer material is composed of a carrier and a toner comprised of at least a binding resin and a colorant.

As binding resins constituting a toner, can be employed, for example, styrene series resins, acryl series resins, styrene-acryl series copolymer resins, styrene-butadiene copolymer resins, epoxy resins, polyester resins and other binding resins conventionally known in the art.

Colorants for a toner include, for example, carbon black, nigrosine dyes, aniline blue, chrome yellow, ultramarine blue, du Pont oil red, quinoline yellow, methylene blue chloride, phthalocyanine blue, malachite green oxalate, rose bengale, and the like.

Development Method

Development Apparatus

The development apparatus is that on the developer material bearing body (hereinafter referred to as sleeve) composed of non-magnetic material such as aluminum, SUS, etc., accommodating a magnet roll provided with a number of N and S in the interior, which is arranged so as to face an electrostatic latent image bearing body, the above-mentioned developer material layer is formed, and during rotation of the developer material bearing body, the developer material layer is formed onto the electrostatic latent image portion on the electrostatic latent image bearing body in keeping the non-contact state, and the electrostatic latent image part is developed employing a toner to enable the formation of a visualized image.

Methods to regulate the developer material layer formed on a developer material bearing body to develop an electrostatic latent image on an electrostatic latent image bearing body are that a metal rod or metal plate with rigidity is arranged on the developer material bearing body in parallel with the developer material bearing body, or is in pressure contact with the developer material bearing body. Furthermore, the above-mentioned metal rod or metal plate can be composed of SUS, aluminum, or other metals conventionally known in the art. The metal rod or metal plate may exhibit magnetism or non-magnetism.

Furthermore, when the development method is employed in that onto an electrostatic latent image part on a electrostatic latent image bearing body, the developer material layer is formed, while keeping a non-contact state, and the electrostatic latent image part is developed employing a toner to form a visualized image, the thickness of the developer material is preferably set, though depending on the distance (hereinafter referred to as Dsd) between the electrostatic latent image bearing body and the developer material bearing body, in the range of ⅕ to ⅘ of Dsd. For example, it is noted that when Dsd is set at 500 μm, the thickness of the developer material layer is preferably set in the range of 100 to 400 μm. When the thickness of the developer materiel is set at not more than ⅕ of Dsd (thickness of the developer material is not more than 100 μm in respect to Dsd=500 μm), the supply capability of the developer material to the electrostatic latent image part on the electrostatic latent image bearing body becomes too small to fully develop the electrostatic latent image. When the thickness of the developer material layer is set at not more than ⅘ in respect to set Dsd (thickness of the developer material layer is not more than 400 μm in respect to Dsd=500 μm), it is not preferred because the carrier in the developer material most adjacent to the electrostatic latent image is transferred to the electrostatic latent image bearing body to cause abrasion on the electrostatic latent image bearing body.

EXAMPLES

The present invention is specifically explained with reference to examples below.

Example 1

Carrier Preparation Example 1

In a high speed stirring type mixer, were mixed, with stirring, 100 weight parts of a magnetite core having a volume average particle diameter of 45 μm and a mole ratio of $FeO/Fe_2O_3$ of 0.20/1.0, and 2.5 weight parts of a styrene-methylmethacrylate copolymer resin (Tg=102° C., Tsp=230° C.) having a number average particle diameter of 2.0 μm, and 0.8 weight parts of magnesium oxide having a number average particle diameter of 2.0 μm, a BET specific surface area of 16 $m^2/g$ at a material's temperature of 30° C. and a peripheral speed of a stirrer blade of 10 m/second for 20 minutes, and a mixture was prepared in which the coating resin and the magnesium atom containing material were adhered on the surface of the magnetic substance particles. The resulting mixture was then mixed with stirring at a material's temperature of 110° C. and a peripheral speed of the stirrer blade of 10 m/second for 40 minutes in the high speed stirring type mixer. By repeatedly applying mechanical impact force to the mixture, onto the surface of the magnetite magnetic substance particles, a resin coating layer comprised of dispersed magnesium oxide was formed. Carrier 1 was thus prepared in which the magnesium atom content ratio on the surface portion was 2.5 (percent in the number of atoms).

Carrier Preparation Example 2

Carrier 2 in which the magnesium atom content ratio on the surface portion of Carrier 2 was 1.6 (percent in the number of atoms) was prepared in the same manner as in Carrier Preparation Example 1, except that 100 parts of the magnetite core having a mole ratio of $FeO/Fe_2O_3$ of 0.15/1.0 was employed and further, 0.5 weight part of magnesium oxide having a number average particle diameter of 2.0 μm and a BET specific surface area of 16 $m^2/g$ was employed.

Carrier Preparation Example 3

Carrier 3 in which the magnesium atom content ratio on the surface portion of Carrier 2 was 3.9 (percent in the number of atoms) was prepared in the same manner as in Carrier Preparation Example 1, except that 100 parts of the magnetite core having a mole ratio of $FeO/Fe_2O_3$ of 0.40/1.0 were employed and further, 1.2 weight parts of magnesium oxide having a number average particle diameter of 2.0 μm and a BET specific surface area of 16 $m^2/g$ were employed.

Carrier Preparation Example 4

Carrier 4 in which the magnesium atom content ratio on the surface portion was 4.9 (percent in the number of atoms) was prepared in the same manner as in Carrier Preparation Example 1, except that 100 parts of a magnetite core having a mole ratio of $FeO/Fe_2O_3$ of 0.65/1.0 were employed and further, 1.0 weight part of magnesium oxide having a number average particle diameter of 0.8 μm and a BET specific surface area of 76 $m^2/g$ was employed.

Carrier Preparation Example 5

Carrier 5 in which the magnesium atom content ratio on the surface portion of Carrier 2 was 3.5 (percent in the number of atoms) was prepared in the same manner as in Carrier Preparation Example 1, except that 100 parts of a magnetite core having a mole ratio of $FeO/Fe_2O_3$ of 0.20/1.0 were employed and further, 1.2 weight parts of magnesium oxide having a number average particle diameter of 2.0 μm and a BET specific surface area of 16 $m^2/g$ were employed.

Comparative Carrier Preparation Example 1

Comparative Carrier 1 in which the magnesium atom content ratio on the surface portion of 0.0 (percent in the number of atoms) was prepared in the same manner as in Carrier Preparation Example 1, except that a magnetite core having a mole ratio of $FeO/Fe_2O_3$ of 0.13/1.0 was employed and further, magnesium oxide was not employed.

Comparative Carrier Preparation Example 2

Comparative Carrier 2 in which the magnesium atom content ratio on the surface portion was 10.5 (percent in the number of atoms) was prepared in the same manner as in Carrier Preparation Example 1, except that the magnetite core having a mole ratio of $FeO/Fe_2O_3$ of 0.13/1.0 was employed and further, 2 weight parts of magnesium oxide having a number average particle diameter of 0.8 μm and a BET specific surface area of 76 $m^2/g$ were employed.

Comparative Carrier Preparation Example 3

Comparative Carrier 3 in which the magnesium atom content ratio on the surface portion was 0.0 (percent in the number of atoms) was prepared in the same manner as in Carrier Preparation Example 1, except that the magnetite core having a mole ratio of $FeO/Fe_2O_3$ of 0.73/1.0 was employed and magnesium oxide was not employed.

Comparative Carrier Preparation Example 4

Comparative Carrier 4 in which the magnesium atom content ratio on the surface portion was 10.3 (percent in the number of atoms) was prepared in the same manner as in Carrier Preparation Example 1, except that the magnetite core having a mole ratio of $FeO/Fe_2O_3$ of 0.73/1.0 was employed and further, 2 weight parts of magnesium oxide having a number average particle diameter of 0.8 μm and a BET specific surface area of 76 $m^2/g$ were employed.

Table 1 shows the mole ratio of $FeO/Fe_2O_3$ and the magnesium atom content ratio of the surface portion of the carrier of each of Carriers 1 through 5 and Comparative Carriers 1 through 4.

TABLE 1

| Present Invention Carrier and Comparative Carrier | Mole Ratio of $FeO/Fe_2O_3$ | Magnesium Atom Content Ratio in Surface Portion of Carrier |
|---|---|---|
| Carrier 1 | 0.20/1.0 | 2.5 |
| Carrier 2 | 0.15/1.0 | 1.6 |
| Carrier 3 | 0.40/1.0 | 3.9 |
| Carrier 4 | 0.65/1.0 | 4.9 |
| Carrier 5 | 0.20/1.0 | 3.5 |
| Comparative Carrier 1 | 0.13/1.0 | 0.0 |
| Comparative Carrier 2 | 0.13/1.0 | 10.5 |
| Comparative Carrier 3 | 0.73/1.0 | 0.0 |
| Comparative Carrier 4 | 0.73/1.0 | 10.3 |

Toner Preparation Example

| | |
|---|---|
| Polyester resin | 100 weight parts |
| Carbon black | 10 weight parts |
| Polypropylene | 4 weight parts |

The above compounds were mixed, kneaded, pulverized and classified to prepare colored particles having a volume average particle diameter of 8.5 $\mu$m. Further, the volume average particle diameter of the colored particles herein is measured using a Coulter Counter-TA-II type (manufactured by Coulter Co.).

To 100 parts of the resulting colored particles, was added 1.2 weight parts of hydrophobic titania particles (diameter of 20 nm), and a toner was prepared by mixing the resulting mixture employing a Henschel mixer.

Examples 1 through 5 and Comparative Examples 1 through 4

Developer materials of the present invention (Developer Materials 1 through 5) and Comparative Developer Materials (Developer Materials 1 through 4) were prepared by mixing 91 weight parts of each of the above-mentioned Carriers 1 through 5 and Comparative Carrier 1 through 4 with 9 weight parts of the above-mentioned toner, employing a V-type mixer.

Practical Print Making Test 1

Each of Developer Materials 1 through 5 of the present invention and Comparative Developer Materials 1 through 4 which were prepared as mentioned above was subjected to the Print Making Test of 100,000 cycles under conditions mentioned below, employing a modified electrophotographic copier "Konica 7050", and evaluation was carried out regarding: (1) machine interior stain caused by toner scattering; (2) background stain on an image; (3) formation of abrasion on the surface portion of an electrostatic latent image bearing body, and (4) formation of white image streak.

Evaluation methods regarding the above-mentioned four items are as follows.

(Machine Interior Stain Caused by Toner Scattering)

The machine interior was visually observed at every 10,000 cycles of print making. The evaluation was carried out according to the following scale:

"A": no machine interior stain is observed.

"B": partial machine interior stain is observed on the upper lid of the development unit (near the sleeve).

"C": machine interior stain is observed on the whole area of the upper lid of the development unit.

"D": almost all the parts in the machine are stained due to toner scattering causing commercial problems.

Formation of Background Stain on Image

The relative density of a white part of an image was measured employing an image densitometer "RD-918 type" (manufactured by Macbeth Co.) at every 10,000 cycles during the Print Making Test. The measured density exceeds 1.0 causing a commercial problem.

Formation of Abrasion on the Surface of Electrostatic Latent Image Bearing Body

At every 10,000 cycles during the Print Making Test, the surface of an electrostatic latent image bearing body was visually observed and evaluation was carried according to the following scale:

"A": no abrasion is observed on the surface.

"C": only very fine streak abrasion is only observed.

"D": abrasion is definitely observed which effects printed images.

Formation of White Image Streak

At every 10,000 cycles during the Print Making Test, a whole solid image was printed and the solid image uniformity was evaluated as follows:

"A": no white streak image defect is observed and solid image uniformity is excellent.

"D": white streak image defect is observed.

The modifications employed for making prints and image printing conditions are mentioned below.

Modifications and Image Printing Conditions

VH=−750 V, VL=−50 V

DC component of developing bias: −650 V

AC component of developing bias: frequency 8 kHz, 2.6 kV

Distance (Dsd) between electrostatic latent image bearing body and sleeve: 550 $\mu$m Thickness of developer material layer: 250 $\mu$m Note: The developer material layer regulating section in the development device was modified so that the thickness of the developer material layer was regulated at a predetermined value.

Material of developer material bearing body: aluminum

Metal rod for regulating developer layer: non-magnetic SUS, 6 mm diameter round rod Combination of image printing environment with black part ratio in original document: refer to Table 2

TABLE 2

| Number of Image Printing Cycles | Ambient Conditions During Test | Black Part Ratio of Original Document (%) |
|---|---|---|
| 1 to 10,000 | 20° C.50% RH | 6 |
| 10,000 to 20,000 | 25° C.20% RH | 6 |
| 20,000 to 30,000 | 30° C.80% RH | 6 |
| 30,000 to 40,000 | 25° C.20% RH | 20 |
| 40,000 to 50,000 | 25° C.20% RH | 3 |
| 50,000 to 60,000 | 25° C.20% RH | 6 |
| 60,000 to 70,000 | 30° C.80% RH | 6 |
| 70,000 to 80,000 | 30° C.80% RH | 20 |
| 80,000 to 90,000 | 25° C.20% RH | 6 |
| 90,000 to 100,000 | 25° C.20% RH | 20 |

Table 3 shows the results on the machine interior stain caused by toner scattering; Table 4 shows the measurement results of the relative density of the white image part; further, Table 5 shows the results of the abrasion on the surface of the electrostatic latent image bearing body, and Table 6 shows the results of the formation of white image streaks.

In Comparative Examples 1 and 2, carrier scattering was caused at the initial stage; at 10,000 cycles, the abrasion was markedly caused, and the white image streaks were also caused. Therefore, the Print Making Test was terminated at the time of 10,000 cycles.

Furthermore, in Comparative Example 3, a charging defect was caused from the initial stage, and the defect was much worsened at the time of 10,000 cycles to cause a remarkable increase in toner scattering and background stain on images. Therefore, the Print Making Test was terminated at the time of 10,000 cycles.

Furthermore, in Comparative Example, charging defect was caused after 20,000 cycles of the Print Making Test in the high humidity environment. As a result, toner scattering and background stain on images were caused. Therefore, the Print Making Test was terminated at the time of 30,000 cycles.

TABLE 3

Machine Interior Stain Caused by Toner Scattering

| Developer | | Number of Print Making Cycles (number) | | | | | | | | | | |
|---|---|---|---|---|---|---|---|---|---|---|---|---|
| Material | Carrier | 1 | 10,000 | 20,000 | 30,000 | 40,000 | 50,000 | 60,000 | 70,000 | 80,000 | 90,000 | 100,000 |
| 1 | 1 | A | A | A | A | A | A | A | A | A | A | A |
| 2 | 2 | A | A | A | A | A | A | A | A | B | B | B |
| 3 | 3 | A | A | A | A | A | A | A | A | A | A | A |
| 4 | 4 | A | A | A | A | A | A | A | A | A | A | B |
| 5 | 5 | A | A | A | A | A | A | A | A | A | A | A |
| Comparative 1 | Comparative 1 | C | D | — | — | — | — | — | — | — | — | — |
| Comparative 2 | Comparative 2 | A | A | — | — | — | — | — | — | — | — | — |
| Comparative 3 | Comparative 3 | C | D | — | — | — | — | — | — | — | — | — |
| Comparative 4 | Comparative 4 | A | A | A | D | — | — | — | — | — | — | — |

TABLE 4

Formation of Background Stain on Images

| Developer | | Number of Print Making Cycles (number) | | | | | | | | | | |
|---|---|---|---|---|---|---|---|---|---|---|---|---|
| Materia1 | Carrier | 1 | 10,000 | 20,000 | 30,000 | 40,000 | 50,000 | 60,000 | 70,000 | 80,000 | 90,000 | 100,000 |
| 1 | 1 | 0.000 | 0.000 | 0.000 | 0.000 | 0.002 | 0.002 | 0.002 | 0.006 | 0.012 | 0.010 | 0.010 |
| 2 | 2 | 0.000 | 0.002 | 0.002 | 0.006 | 0.004 | 0.006 | 0.004 | 0.008 | 0.016 | 0.012 | 0.014 |
| 3 | 3 | 0.000 | 0.000 | 0.000 | 0.010 | 0.004 | 0.002 | 0.006 | 0.018 | 0.032 | 0.016 | 0.022 |
| 4 | 4 | 0.002 | 0.004 | 0.002 | 0.018 | 0.008 | 0.004 | 0.006 | 0.024 | 0.042 | 0.030 | 0.038 |
| 5 | 5 | 0.000 | 0.000 | 0.000 | 0.000 | 0.002 | 0.002 | 0.002 | 0.006 | 0.010 | 0.010 | 0.012 |
| Comparative 1 | Comparative 1 | 0.062 | 0.222 | — | — | — | — | — | — | — | — | — |
| Comarative 2 | Comparative 2 | 0.000 | 0.000 | — | — | — | — | — | — | — | — | — |
| Comparative 3 | Comparative 3 | 0.066 | 0.230 | — | — | — | — | — | — | — | — | — |
| Comparative 4 | Comarative 4 | 0.010 | 0.018 | 0.022 | 0.182 | — | — | — | — | — | — | — |

TABLE 5

Abrasion Formation on Surface of Electrostatic Latent Image Bearing Body

| Developer | | Number of Print Making Cycles (number) | | | | | | | | | | |
|---|---|---|---|---|---|---|---|---|---|---|---|---|
| Material | Carrier | 1 | 10,000 | 20,000 | 30,000 | 40,000 | 50,000 | 60,000 | 70,000 | 80,000 | 90,000 | 100,000 |
| 1 | 1 | A | A | A | A | A | A | A | A | A | A | A |
| 2 | 2 | A | A | A | A | A | A | A | A | B | B | B |
| 3 | 3 | A | A | A | A | A | A | A | A | A | A | A |
| 4 | 4 | A | A | A | A | A | A | A | A | A | A | B |
| 5 | 5 | A | A | A | A | A | A | A | A | A | A | A |
| Comparative 1 | Comparative 1 | C | D | — | — | — | — | — | — | — | — | — |
| Comparative 2 | Comparative 2 | C | D | — | — | — | — | — | — | — | — | — |
| Comparatiive 3 | Comparative 3 | A | A | — | — | — | — | — | — | — | — | — |
| Comparative 4 | Comparative 4 | A | A | A | A | — | — | — | — | — | — | — |

TABLE 6

| Developer | | Formation of White Image Streak | | | | | | | | | | |
|---|---|---|---|---|---|---|---|---|---|---|---|---|
| | | Number of Print Making Cycles (number) | | | | | | | | | | |
| Material | Carrier | 1 | 10,000 | 20,000 | 30,000 | 40,000 | 50,000 | 60,000 | 70,000 | 80,000 | 90,000 | 100,000 |
| 1 | 1 | A | A | A | A | A | A | A | A | A | A | A |
| 2 | 2 | A | A | A | A | A | A | A | A | B | B | B |
| 3 | 3 | A | A | A | A | A | A | A | A | A | A | A |
| 4 | 4 | A | A | A | A | A | A | A | A | A | A | B |
| 5 | 5 | A | A | A | A | A | A | A | A | A | A | A |
| Comparative 1 | Comparative 1 | A | D | — | — | — | — | — | — | — | — | — |
| Comparative 2 | Comparative 2 | A | D | — | — | — | — | — | — | — | — | — |
| Comparative 3 | Comparative 3 | A | A | — | — | — | — | — | — | — | — | — |
| Comparative 4 | Comparative 4 | A | A | A | A | — | — | — | — | — | — | — |

As can be clearly seen in Tables 1 through 6, when Developer Materials 1 through 5 of the present invention are employed, no abrasion is caused on the surface of an electrostatic latent image bearing body due to no carrier scattering to the surroundings; excellent charging properties can be stably exhibited over an extended period of time; no white streak image is formed, and no performance depends on ambient conditions. Therefore, during the Print Making Test of 100,000 cycles, neither toner scattering nor background stain on images is caused; no abrasion on the surface of the electrostatic latent image bearing body is caused, and no white streak images are formed. As a result, excellent images can be printed.

Example 2

Carrier Preparation Example 6

In a high speed stirring type mixer, were mixed, with stirring, 100 weight parts of a magnetite core having a volume average particle diameter of 45 $\mu$m and a mole ratio of $FeO/Fe_2O_3$ of 0.20/1.0, and 2.0 weight parts of a styrene-methylmethacrylate copolymer resin (Tg=102° C., Tsp=230° C.) having a number average particle diameter of 2.0 $\mu$m, and 0.8 weight parts of magnesium oxide, prepared by a wet process, having a number average particle diameter of 2.0 $\mu$m, a BET specific surface area of 16 $m^2/g$, and a weight decrease ratio of 3.2 (weight percent) in the range of 200 to 500° C. when heated at a rate of 5° C./minute in the atmosphere at a material's temperature of 30° C. and a peripheral speed of a stirrer blade of 10 m/second for 20 minutes, and a mixture was prepared in which the coating resin and the magnesium atom containing material were adhered on the surface of the magnetic substance particles. The resulting mixture was then mixed with stirring at a material's temperature of 110° C. and a peripheral speed of the stirrer blade of 10 m/second for 40 minutes in a high speed stirring type mixer. By repeatedly applying mechanical impact force to the mixture, onto the surface of the magnetite magnetic substance particles, Carrier 6 was prepared in which a resin coating layer comprised of dispersed magnesium oxide was formed.

Carrier Preparation Example 7

Carrier 7 was prepared in the same manner as in Carrier Preparation Example 6, except that 100 weight parts of a magnetite core having a mole ratio of $FeO/Fe_2O_3$ of 0.15/1.0, and 0.8 weight part of magnesium oxide, prepared by a wet process, having a number average particle diameter of 2.0 $\mu$m, a BET specific surface area of 16 $m^2/g$, and a weight decrease ratio of 17.6 (weight percent) in the range of 200 to 500° C. when heated at a rate of 5° C./minute in the atmosphere were employed.

Carrier Preparation Example 8

Carrier 8 was prepared in the same manner as in Carrier Preparation Example 6, except that 100 weight parts of the magnetite core having a mole ratio of $FeO/Fe_2O_3$ of 0.40/1.0 were employed and further, 0.8 weight part of magnesium oxide, prepared by a wet process, having a number average particle diameter of 2.0 $\mu$m, a BET specific surface area of 16 $m^2/g$, and a weight decrease ratio of 2.1 (weight percent) in the range of 200 to 500° C. when heated at a rate of 5° C./minute in the atmosphere was employed.

Carrier Preparation Example 9

Carrier 9 was prepared in the same manner as in Carrier Preparation Example 6, except that 100 weight parts of the magnetite core having a mole ratio of $FeO/Fe_2O_3$ of 0.65/1.0 were employed and further, 0.8 weight part of magnesium oxide, prepared by a wet process, having a number average particle diameter of 2.0 $\mu$m, a BET specific surface area of 16 $m^2/g$, and a weight decrease ratio of 29.8 (weight percent) in the range of 200 to 500° C. when heated at a rate of 5° C./minute in the atmosphere was employed.

Comparative Carrier Preparation Example 5

Comparative Carrier 5 was prepared in the same manner as in Carrier Preparation Example 6, except that the magnetite core having a mole ratio of $FeO/Fe_2O_3$ of 0.13/1.0 was employed and further, 0.8 weight part of magnesium oxide, prepared by a wet process, having a number average particle diameter of 2.0 $\mu$m, a BET specific surface area of 16 $m^2/g$, and a weight decrease ratio of 1.6 (weight percent) in the range of 200 to 500° C. when heated at a rate of 5° C./minute in the atmosphere was employed.

Comparative Carrier Preparation Example 6

Comparative Carrier 6 was prepared in the same manner as in Carrier Preparation Example 6, except that the magnetite core having a mole ratio of $FeO/Fe_2O_3$ of 0.13/1.0 was employed and further, 0.8 weight part of magnesium oxide, prepared by a wet process, having a number average particle diameter of 2.0 $\mu$m, a BET specific surface area of 16 $m^2/g$, and a weight decrease ratio of 33.2 (weight percent) in the range of 200 to 500° C. when heated at a rate of 5° C./minute in the atmosphere was employed.

Comparative Carrier Preparation Example 7

Comparative Carrier 7 was prepared in the same manner as in Carrier Preparation Example 6, except that the magnetite core having a mole ratio of $FeO/Fe_2O_3$ of 0.73/1.0 was employed and further, 0.8 weight part of magnesium oxide, prepared by a wet process, having a number average particle diameter of 2.0 $\mu$m, a BET specific surface area of 16 $m^2/g$, and a weight decrease ratio of 1.6 (weight percent) in the range of 200 to 500° C. when heated at a rate of 5° C./minute in the atmosphere was employed.

Comparative Carrier Preparation Example 8

Comparative Carrier 8 was prepared in the same manner as in Carrier Preparation Example 6, except that the magnetite core having a mole ratio of $FeO/Fe_2O_3$ of 0.73/1.0 was employed and further, 0.8 weight part of magnesium oxide, prepared by a wet process, having a number average particle diameter of 2.0 $\mu$m, a BET specific surface area of 16 $m^2/g$, and a weight decrease ratio of 33.2 (weight percent) in the range of 200 to 500° C. when heated at a rate of 5° C./minute in the atmosphere was employed.

Table 7 shows the mole ratio of $FeO/Fe_2O_3$ of each of Carriers 6 through 9 and Comparative Carrier 5 through 8 and the weight decrease ration "W(loss)" in the range of 200 to 500° C. when heated at a rate of 5° C./minute in the atmosphere of each of these Carriers 6 through 9 and Comparative Carrier 5 through 8. The magnesium atom content ratio on the surface, in which the resin coating is formed, of these Carrier 6 through 9 and Comparative Carrier 5 through 8 is 2.5 by percent in the number of atoms.

TABLE 7

| Present Invention Carrier and Comparative Carrier | Mole Ratio of $FeO/Fe_2O_3$ | W (loss) (weight %) | Number of Atoms (%) |
|---|---|---|---|
| Carrier 6 | 0.20/1.0 | 3.2 | 2.5 |
| Carrier 7 | 0.15/1.0 | 17.6 | 2.5 |
| Carrier 8 | 0.40/1.0 | 2.1 | 2.5 |
| Carrier 9 | 0.65/1.0 | 29.8 | 2.5 |
| Comparative Carrier 5 | 0.13/1.0 | 1.6 | 2.5 |
| Comparative Carrier 6 | 0.13/1.0 | 33.2 | 2.5 |
| Comparative Carrier 7 | 0.73/1.0 | 1.6 | 2.5 |
| Comparative Carrier 8 | 0.73/1.0 | 33.2 | 2.5 |

Examples 6 through 9 and Comparative Examples 5 through 8

The developer materials (Developer Materials 6 through 9) of the present invention and Comparative Developer Materials (Developer Materials 5 through 8) were prepared by mixing 91 weight parts of each of the above mentioned Carriers 6 through 9 and Comparative Carriers 5 through 8 with 9 parts of the above-mentioned toner employed in Example 1 employing a V-type mixer.

Practical Print Making Test 2

Each of Developer Materials 6 through 9 of the present invention and Comparative Developer Materials 5 through 8 which were prepared as mentioned above was subjected to the Print Making Test of 100,000 cycles under conditions mentioned below, employing a modified electrophotographic copier "Konica 7050", and evaluation was carried out regarding: (1) machine interior stain caused by toner scattering; (2) background stain on an image; (3) formation of abrasion on the surface of an electrostatic latent image bearing body, and (4) formation of white image streak.

Evaluation methods regarding the above-mentioned four items are the same as those described in Example 1.

Furthermore, modifications for print making and print making conditions, and combinations of ambient conditions with print making and black area ratio of an original document are the same as those described in Example 1.

Table 8 shows the results on the machine interior stain cased by toner scattering; Table 9 shows the measurement results of the relative density of the white image part; further, Table 10 shows the results on the abrasion formation on the surface of the electrostatic latent image bearing body, and Table 11 shows the results on the formation of white image streaks.

In Comparative Examples 5 and 6, the carrier scattering was caused at the initial stage; at 10,000 cycles, the abrasion was markedly caused, and the white image streak was also caused. Therefore, the Print Making Test was terminated at the time of 10,000 cycles.

In Comparative Example 7, the remarkable decrease in image density and remarkable increase in toner scattering and background stain on images were caused. Therefore, the Print Making Test was terminated at the time of 30,000 cycles.

In addition, in Comparative Example 8, charging defect was markedly caused after 20,000 cycles of the Print Making Test in high humidity environment. As a result, toner scattering and background stain on images were caused. Therefore, the Print Making Test was terminated at the time of 30,000 cycles.

TABLE 9

Formation of Background Stain on Images

| Developer | | Number of Print Making Cycles (number) | | | | | | | | | | |
|---|---|---|---|---|---|---|---|---|---|---|---|---|
| Materia1 | Carrier | 1 | 10,000 | 20,000 | 30,000 | 40,000 | 50,000 | 60,000 | 70,000 | 80,000 | 90,000 | 100,000 |
| 6 | 6 | 0.000 | 0.000 | 0.000 | 0.000 | 0.002 | 0.002 | 0.002 | 0.006 | 0.012 | 0.010 | 0.010 |
| 7 | 7 | 0.000 | 0.002 | 0.002 | 0.006 | 0.004 | 0.006 | 0.004 | 0.008 | 0.016 | 0.012 | 0.014 |
| 8 | 8 | 0.000 | 0.000 | 0.000 | 0.010 | 0.004 | 0.002 | 0.006 | 0.018 | 0.032 | 0.016 | 0.022 |
| 9 | 9 | 0.002 | 0.004 | 0.002 | 0.018 | 0.008 | 0.004 | 0.006 | 0.024 | 0.042 | 0.030 | 0.038 |
| Comparative 5 | Comparative 5 | 0.000 | 0.002 | — | — | — | — | — | — | — | — | — |
| Comparative 6 | Comparative 6 | 0.002 | 0.002 | — | — | — | — | — | — | — | — | — |
| Comparative 7 | Comparative 7 | 0.002 | 0.002 | 0.002 | 0.204 | — | — | — | — | — | — | — |
| Comparative 8 | Comparative 8 | 0.004 | 0.008 | 0.012 | 0.190 | — | — | — | — | — | — | — |

TABLE 10

| Developer | | Abrasion Formation on Surface of Electrostatic Latent Image Bearing Body | | | | | | | | | | |
|---|---|---|---|---|---|---|---|---|---|---|---|---|
| | | Number of Print Making Cycles (number) | | | | | | | | | | |
| Material | Carrier | 1 | 10,000 | 20,000 | 30,000 | 40,000 | 50,000 | 60,000 | 70,000 | 80,000 | 90,000 | 100,000 |
| 6 | 6 | A | A | A | A | A | A | A | A | A | A | A |
| 7 | 7 | A | A | A | A | A | A | A | A | B | B | B |
| 8 | 8 | A | A | A | A | A | A | A | A | A | A | A |
| 9 | 9 | A | A | A | A | A | A | A | A | A | A | B |
| Comparative 5 | Comparative 5 | C | D | — | — | — | — | — | — | — | — | |
| Comparative 6 | Comparative 6 | C | D | — | — | — | — | — | — | — | — | — |
| Comparative 7 | Comparative 7 | A | A | A | A | — | — | — | — | — | — | — |
| Comparative 8 | Comparative 8 | A | A | A | A | — | — | — | — | — | — | — |

TABLE 10

| Developer | | Abrasion Formation on Surface of Electrostatic Latent Image Bearing Body | | | | | | | | | | |
|---|---|---|---|---|---|---|---|---|---|---|---|---|
| | | Number of Print Making Cycles (number) | | | | | | | | | | |
| Material | Carrier | 1 | 10,000 | 20,000 | 30,000 | 40,000 | 50,000 | 60,000 | 70,000 | 80,000 | 90,000 | 100,000 |
| 6 | 6 | A | A | A | A | A | A | A | A | A | A | A |
| 7 | 7 | A | A | A | A | A | A | A | A | B | B | B |
| 8 | 8 | A | A | A | A | A | A | A | A | A | A | A |
| 9 | 9 | A | A | A | A | A | A | A | A | A | A | B |
| Comparative 5 | Comparative 5 | C | D | — | — | — | — | — | — | — | — | — |
| Comparative 6 | Comparative 6 | C | D | — | — | — | — | — | — | — | — | — |
| Comparative 7 | Comparative 7 | A | A | A | A | — | — | — | — | — | — | — |
| Comparative 8 | Comparative 8 | A | A | A | A | — | — | — | — | — | — | — |

TABLE 11

| Developer | | Formation of White Image Streak | | | | | | | | | | |
|---|---|---|---|---|---|---|---|---|---|---|---|---|
| | | Number of Print Making Cycles (number) | | | | | | | | | | |
| Material | Carrier | 1 | 10,000 | 20,000 | 30,000 | 40,000 | 50,000 | 60,000 | 70,000 | 80,000 | 90,000 | 100,000 |
| 6 | 6 | A | A | A | A | A | A | A | A | A | A | A |
| 7 | 7 | A | A | A | A | A | A | A | A | B | B | B |
| 8 | 8 | A | A | A | A | A | A | A | A | A | A | A |
| 9 | 9 | A | A | A | A | A | A | A | A | A | A | B |
| Comparative 5 | Comparative 5 | A | D | — | — | — | — | — | — | — | — | — |
| Comparative 6 | Comparative 6 | A | D | — | — | — | — | — | — | — | — | — |
| Comparative 7 | Comparative 7 | A | A | A | A | — | — | — | — | — | — | — |
| Comparative 8 | Comparative 8 | A | A | A | A | — | — | — | — | — | — | — |

As can be clearly seen in Tables 8 through 11, when Developer Materials 6 through 9 of the present invention are employed, no abrasion is caused on the surface of an electrostatic latent image bearing body due to no carrier scattering to the surroundings; excellent charging properties can be stably exhibited over an extended period of time; no white streak images are formed, and no performance depends on ambient conditions. Therefore, during the Print Making Test of 100,000 cycles, neither toner scattering nor background stain on images is caused; no abrasion on the surface of the electrostatic latent image bearing body is caused, and no white streak images are formed. As a result, excellent images can be printed.

As demonstrated in the Examples, the carrier for developing an electrostatic latent image and developer material for developing the same, and the development method according to the present invention exhibit excellent advantages in that no carrier adhesion is caused during the initial stage and also the normal running stage; no abrasion is formed on an electrostatic latent image bearing body; as a result, no white streak image defect is caused; furthermore, neither toner scattering nor background stain on images is caused during an extended print making period, and excellent images are stably formed.

We claim:

1. A carrier for developing an electrostatic latent image comprising a core comprising magnetite and a resin coated on the core wherein the magnetite contains FeO and $Fe_2O_3$, the mole ratio of $FeO/Fe_2O_3$ being 0.15/1.0 to 0.7/1.0, and the carrier contains a magnesium atom containing material at a surface of the carrier, magnesium atom content ratio at the surface being 1.5 to 5.0 (percent in the number of atoms).

2. A carrier of claim 1 wherein the magnesium atom containing material exhibits a weight decrease ratio of 2 to 30 weight percent in the range of 200 to 500° C. in case that it is heated at a rate of 5° C./minute in an atmosphere.

3. A carrier of claim 1 wherein the magnesium atom containing material is magnesium oxide, magnesium hydroxide, magnesium carbonate or mixture of magnesium oxide and magnesium carbonate.

4. A carrier of claim 1 wherein the magnesium atom containing material has BET specific surface area of 5 to 300 $m^2/g$.

5. A carrier of claim 4 wherein the magnesium atom containing material has BET specific surface area of 10 and 200 $m^2/g$.

6. A carrier of claim 1 wherein the magnesium atom containing material has average particle diameter of 10 nm to 3 $\mu$m.

7. A carrier of claim 6 wherein the magnesium atom containing material has average particle diameter of 50 nm to 2.5 $\mu$m.

8. A developer material for developing an electrostatic latent image comprising a carrier and a toner containing at least a binder resin and a colorant wherein the carrier is that claimed in claim 1.

9. The carrier of claim 1, wherein the glass transition point (Tg) of the resin is 50 to 200° C.

10. The carrier of claim 9, wherein the resin has a softening point of 80 to 300° C.

11. The carrier of claim 1, comprising the resin in an amount of 0.05 to 8 weight percent of the core.

12. The carrier of claim 5, wherein the magnesium atom containing material has an average particle diameter of 50 nm to 2.5 $\mu$m.

13. The carrier of claim 3, wherein the magnesium atom containing material has BET specific surface area of 5 to 300 $m^2/g$ and an average particle diameter of 10 nm to 3 $\mu$m.

14. The carrier of claim 1, wherein the core consists of the magnetite.

15. The carrier of claim 3, wherein the core consists of the magnetite.

16. The developer of claim 8, wherein the magnesium atom containing material has BET specific surface area of 5 to 300 $m^2/g$ and an average particle diameter of 10 nm to 3 $\mu$m.

17. The developer of claim 16, wherein the core consists of the magnetite.

18. The developer of claim 17, wherein the magnesium atom containing material is magnesium oxide, magnesium hydroxide, magnesium carbonate or mixture of magnesium oxide and magnesium carbonate.

* * * * *

UNITED STATES PATENT AND TRADEMARK OFFICE

CERTIFICATE OF CORRECTION

PATENT NO. : 6,051,352
DATED : April 18, 2000
INVENTOR(S) : Umeno et al.

It is certified that error appears in the above-identified patent and that said Letters Patent is hereby corrected as shown below:

Column 2,
Line 60, after “containing a” delete “leas t” and insert therefor -- least --

Column 16,
Before Table 9, insert attached Table 8

Column 17,
Delete Table 10, second occurrence

Signed and Sealed this

Thirteenth Day of January, 2004

JON W. DUDAS
*Acting Director of the United States Patent and Trademark Office*

Table 8

- Machine Interior Stain Caused by Toner Scattering -

| Developer Material | Carrier | Number of Print Making Cycles (number) | | | | | | | | | | |
|---|---|---|---|---|---|---|---|---|---|---|---|---|
| | | 1 | 10,000 | 20,000 | 30,000 | 40,000 | 50,000 | 60,000 | 70,000 | 80,000 | 90,000 | 100,000 |
| 6 | 6 | A | A | A | A | A | A | A | A | A | A | A |
| 7 | 7 | A | A | A | A | A | A | A | A | B | B | B |
| 8 | 8 | A | A | A | A | A | A | A | A | A | A | A |
| 9 | 9 | A | A | A | A | A | A | A | A | A | A | B |
| Comparative 5 | Comparative 5 | A | A | - | - | - | - | - | - | - | - | - |
| Comparative 6 | Comparative 6 | A | A | - | - | - | - | - | - | - | - | - |
| Comparative 7 | Comparative 7 | A | A | A | D | - | - | - | - | - | - | - |
| Comparative 8 | Comparative 8 | A | A | A | D | - | - | - | - | - | - | - |